US006666607B2

(12) United States Patent
Gueret

(10) Patent No.: US 6,666,607 B2
(45) Date of Patent: Dec. 23, 2003

(54) APPLICATOR AND METHOD FOR APPLYING A PRODUCT

(75) Inventor: Jean-Louis H. Gueret, Paris (FR)

(73) Assignee: L'Oreal S.A., Paris (FR)

( * ) Notice: Subject to any disclaimer, the term of this patent is extended or adjusted under 35 U.S.C. 154(b) by 0 days.

(21) Appl. No.: 09/970,861

(22) Filed: Oct. 5, 2001

(65) Prior Publication Data

US 2002/0048482 A1 Apr. 25, 2002

(30) Foreign Application Priority Data

Oct. 5, 2000 (FR) ..... 00 12735

(51) Int. Cl.[7] ..... A45D 33/00; A46B 11/00

(52) U.S. Cl. ..... 401/130; 401/128; 401/126; 401/122

(58) Field of Search ..... 401/130, 128, 401/126, 120, 118; 132/313

(56) References Cited

U.S. PATENT DOCUMENTS

| | | | | |
|---|---|---|---|---|
| 1,909,096 A | * | 5/1933 | Cooney | 401/130 |
| 1,999,642 A | | 4/1935 | Shepherd | |
| 2,029,835 A | | 2/1936 | Reichle | |
| 2,561,252 A | | 7/1951 | Waring | |
| 2,681,463 A | | 6/1954 | Gordon | |
| 2,990,563 A | * | 7/1961 | Davidson | 401/128 |
| 4,841,996 A | | 6/1989 | Gueret | |
| 4,955,745 A | | 9/1990 | Vauquelin | |
| 5,888,005 A | | 3/1999 | Gueret | |
| 6,286,518 B1 | | 9/2001 | Laporte | |
| 6,331,085 B1 | * | 12/2001 | Schrepf et al. | 401/128 |

FOREIGN PATENT DOCUMENTS

| | | |
|---|---|---|
| DE | 41 29 585 | 3/1993 |
| EP | 0 436 264 | 7/1991 |
| FR | 1 174 544 | 3/1959 |
| FR | 2 599 230 | 12/1987 |
| FR | 2 713 059 | 6/1995 |
| FR | 2 730 704 | 8/1996 |
| FR | 2 782 614 | 3/2000 |

OTHER PUBLICATIONS

English language Derwent Abstract of DE 41 29 585, Mar. 11, 1993.

English language Derwent Abstract of FR 2 713 059, Jun. 9, 1995.

* cited by examiner

*Primary Examiner*—David J. Walczak
(74) *Attorney, Agent, or Firm*—Finnegan, Henderson, Farabow, Garrett & Dunner, LLP

(57) ABSTRACT

An applicator for applying a product comprises an applicator element configured to be loaded with product to be applied. The applicator element comprises a wall defining a cavity in which product accumulates. The cavity may have at least one opening through which product to be applied passes. The opening may be at an end of the applicator element and at least one retention element may be disposed inside the cavity. The wall and the at least one retention element may be configured so as to hold product substantially within the cavity. The wall and the at least one retention element may further be configured so as to hold product substantially within the cavity via capillary attraction.

180 Claims, 3 Drawing Sheets

APPLICATOR AND METHOD FOR APPLYING A PRODUCT

The present invention relates to an applicator and method for applying a product. In particular, the invention relates to an applicator and method for applying a cosmetic product, such as nail varnish or lip make-up, for example, or a care product. The applicator and method for applying may be especially suitable for applying a liquid or semi-liquid product.

The invention may include an applicator that may enable application of a product to be performed with precision. Moreover, the applicator may be used for at least a length of time sufficient to enable a product, such as a cosmetic or a care product, to be applied under good conditions.

It should be understood that the invention could be practiced without performing one or more of the objects and/or advantages described herein. Other objects and advantages of the invention may become apparent from the description which follows.

In accordance with the purposes of the invention, as embodied and broadly described herein, the invention includes an applicator element configured to be loaded with product to be applied. The applicator element may comprise a wall defining a cavity in which product accumulates. The cavity has at least one opening through which product to be applied passes. The at least one opening is disposed at an end of the applicator element. The applicator element may further comprise at least one retention element disposed inside the cavity. The wall and the at least one retention element may be configured such that the product is held substantially within the cavity.

According to another aspect, the invention may include an applicator for applying a product comprising an applicator element configured to be loaded with product to be applied. The applicator element may comprise a substantially elongate, hollow enclosure having a proximal end and a distal end. The distal end may define at least one opening through which the product to be applied passes. The applicator element may further comprise at least one retention element disposed within the hollow enclosure. The at least one retention element and the enclosure may be configured so as to hold product substantially within the enclosure.

In an exemplary embodiment, the wall and the at least one retention element may be configured such that the product is held between the wall and the at least one retention element via capillary attraction. In another exemplary embodiment, the at least one retention element and the enclosure may be configured such that the product is held substantially within the enclosure via capillary attraction. That is, the wall and the retention element, or the enclosure and the retention element, have a configuration with respect to each other such that the adhesion forces between the product and the surfaces of the wall, or the enclosure, and the retention element are greater than the internal cohesion of the product itself. This may cause the product to be raised against the surfaces of the wall and the retention element. In other words, the adhesion forces may thus at least substantially prevent the product from exiting the cavity in the absence of external forces (i.e., forces other than those associated with the weight of the product itself). In an exemplary embodiment, the product is a liquid or semi-liquid and the surfaces of the wall, the enclosure, and the retention element are substantially solid.

The wall may surround the entire cavity or at least substantially the entire cavity. In an embodiment, the at least one opening is a single opening. This single opening may permit relatively precise application of product and may be configured so as to be suitable for applying liquid to fingernails or toenails, for example.

The retention element may allow the at least one opening through which product passes to be of relatively large dimensions for application purposes while substantially preventing the product from exiting the cavity when the applicator element is not being used to apply the product. Further, the cavity also may have a relatively large volume. This may permit continued use of the applicator for a sufficient length of time before it becomes necessary to reload the applicator element with product.

Optionally, the at least one opening is at a distal end of the applicator element, and the wall defines at least one vent opening proximate a proximal end of the applicator element. The proximal end may be located opposite to the distal end.

The at least one retention element may be disposed completely within the cavity. An end of the at least one retention element may be substantially flush with a plane defined by the opening of the cavity. Alternatively, an end of the at least one retention element proximate the opening may be disposed at a distance from a plane defined by the opening. The end of the at least one retention element may be at a distance ranging from approximately 0.5 mm to approximately 3 mm from the plane defined by the opening. More particularly, the end of the at least one retention element may be at a distance ranging from approximately 1 mm to approximately 2 mm from the plane defined by the opening. This disposition makes it possible to avoid direct contact between the retention element and the surface on which the liquid is deposited, where such contact can interfere with uniform application of the liquid.

According to an aspect, the at least one opening is disposed in a plane that extends substantially obliquely relative to a longitudinal axis of the cavity. This may facilitate application of the product to a surface.

In an exemplary embodiment, the wall may be cylindrical at least over a portion of its height. A transverse cross-section of at least a portion of the wall, or a portion of the enclosure, may be substantially circular, substantially oblong, substantially polygonal, substantially bean-shaped, or any other suitable cross-sectional shape. The particular shape chosen may depend on factors such as the nature of the product and the type of application.

In an embodiment, the at least one retention element may be formed integrally with the wall or with the enclosure. Optionally, they may be formed by injection molding of a plastic material, for example. As yet another option, the retention element may be made as a single piece with the wall or the enclosure.

According to an aspect, the at least one retention element may be fixed within the cavity. The applicator may further comprise at least one fin extending from the at least one retention element and configured to hold the at least one retention element within the cavity. The at least one retention element and the at least one fin may be formed integrally, for example, as a single piece. They may be formed by injection-molding a plastic, for example.

The at least one fin may extend substantially radially from the at least one retention element, and the at least one fin may be configured to hold the at least one retention element inside the cavity via friction fit with an interior surface of the wall or the enclosure. Alternatively, some other suitable mechanism for holding the retention element within the cavity may be used.

The applicator may further comprise flocking in an exemplary embodiment. The flocking may be on at least a portion of at least one of the wall and the at least one retention element. Such flocking may increase the amount of product that is retained on the applicator element and/or control a flow rate of the product. Indeed, such flocking may make application of the product more uniform and any contact with the treated surface more flexible.

According to another exemplary embodiment, the applicator further comprises a rod and the applicator element may be connected to the rod. The longitudinal axis of the applicator element optionally forms a non-zero angle with a longitudinal axis of the rod. For example, the longitudinal axis of the applicator may be substantially parallel to a longitudinal axis of the rod.

As an option, the wall or the enclosure may be connected to the rod. The applicator also may comprise a handle member and the rod may be connected to the handle member. According to an aspect, the handle member may be formed as a single piece with the rod. In yet another aspect, the rod and the wall may be formed as a single piece. The at least one retention element and the rod may optionally be formed integrally, for example, as a single piece. Also optionally, the retention element and the rod may be formed by injection molding a plastic, for example.

Optionally, the rod is at least as flexible as the applicator element. This may ensure that the applicator is flexible in the event that the applicator element comes into contact with the surface being treated. Also optionally, a diameter of the rod may be not larger than a diameter of the applicator element. This also may confer flexibility to the applicator.

In an aspect, the at least one retention element forms a non-zero angle with the rod. The at least one retention element may be adjustably fixed to the wall, or adjustably fixed to the enclosure. This may permit modification of the manner in which the product is released.

The at least one retention element and the wall, or the at least one retention element and the enclosure, may be made of materials that differ from each other.

According to an aspect, the wall comprises a substantially vertical wall portion and a substantially transverse wall portion, the substantially transverse wall portion may be connected to the rod. The enclosure may comprise a substantially vertical wall portion and a substantially transverse wall portion, with the transverse wall portion connected to the rod. The substantially transverse wall portion and the rod may be connected or formed as a single piece.

In an exemplary embodiment, the applicator further comprises a cap configured to close a receptacle for containing a product to be applied. The rod may be connected to the cap. The cap may be configured to close the receptacle in a sealed manner.

The wall may be tapered along at least part of its length. The enclosure also may be tapered along at least part of its length. Optionally, the wall, or the enclosure, may taper in a direction away from the opening. Also optionally, the wall or the enclosure may flare outwardly in a direction toward the opening.

According to an aspect, the at least one retention element may be disposed substantially centrally within the cavity. The at least one retention element may be substantially elongate. The cavity may have a longitudinal axis and the at least one retention element may extend substantially parallel to the longitudinal axis. As an option, the longitudinal axis of the cavity is a curved longitudinal axis.

In an exemplary embodiment, the wall and the at least one retention element are further configured such that a drop of product is formed at the opening when product is held between the wall and the at least one retention element. In another exemplary embodiment, the enclosure and the at least one retention element are further configured such that a drop of product is formed at the opening when product is held substantially within the enclosure.

In an embodiment, the at least one retention element and the wall form an angle that either diverges or converges toward the at least one opening. In another embodiment, the at least one retention element and the enclosure form an angle that either diverges or converges toward the at least one opening. In the case of a converging angle, a portion of the applicator element may be more pointed so as to permit a relatively more precise application.

The wall or enclosure may flare in the vicinity of the opening used for application purposes, for example, in order to modify the characteristics of the drop of liquid that may be formed at the opening.

According to yet another aspect, the invention includes a system for applying a product comprising a receptacle configured to contain a product to be applied and any of the applicators described above. The applicator element may be configured to be inserted into the receptacle.

The system may further comprise a wiper member for wiping the applicator element as the applicator element is withdrawn from the receptacle. The wiper member may be configured to wipe an outer surface of the wall as the applicator element is withdrawn from the receptacle. Alternatively, the wiper member may be configured to wipe an outer surface of the enclosure as the applicator element is withdrawn from the receptacle.

Optionally, the system further comprises the product in the receptacle. The product may be chosen from a care product and a cosmetic product. In an exemplary embodiment, the cosmetic product is chosen from lip make-up and nail varnish.

Yet another aspect of the invention includes a method of applying a product to a surface. The method may comprise providing any of the applicators discussed above, loading the applicator element with product such that product is held between the wall and the at least one retention element, and depositing at least some of the loaded product onto a surface. The method may further comprise moving the applicator element relative to the surface so as to apply the product over at least a portion of the surface.

It is noted that the term "providing" is used broadly, and refers to, but is not limited to, making available for use, giving, supplying, obtaining, getting a hold of, acquiring, purchasing, selling, distributing, possessing, making ready for use, and/or placing in a position ready for use.

The loading of the applicator element may comprise immersing the applicator element at least partially in the product to be applied.

The depositing of at least some of the product on the surface may comprise depositing at least a drop of the product formed at the at least one opening of the cavity. In an exemplary embodiment, the depositing of at least some of the product on the surface occurs at least substantially without bringing the applicator element into contact with the surface.

As an option, the product may be chosen from a cosmetic product and a care product. More particularly, the cosmetic product may be chosen from a lip make-up and a nail varnish. Further, the product may be chosen from one of a liquid and semi-liquid product. The depositing of at least some of the loaded product onto a surface may comprise depositing at least some of the loaded product onto one of skin, hair, a fingernail, and a toenail.

Aside from the structural and procedural arrangements set forth above, the invention could include a number of other arrangements, such as those explained hereinafter. It is to be understood that both the foregoing description and the following description are exemplary, and are intended to provide further explanation of the invention as claimed.

The accompanying drawings are included to provide a further understanding of the invention and are incorporated in and constitute a part of this specification. The drawings illustrate embodiments of the invention and, together with the description, serve to explain the principles of the invention. In the drawings, FIG. 1 is an axial cross-sectional view of an embodiment of a device for applying a product;

Reference will now be made in detail to some exemplary embodiments of the invention, as illustrated in the accompanying drawings. Wherever possible, the same reference numbers are used in the drawings and the description to refer to the same or like parts.

Figure 1:
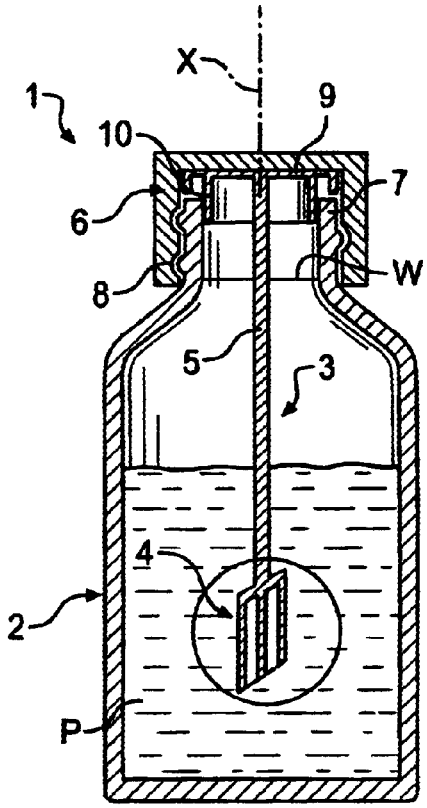

FIG. 1 shows an applicator system 1 comprising a receptacle 2 having an axis X, and an applicator 3. The applicator 3 comprises an applicator element 4 connected by a rod 5 to a handle 6. The handle 6 also may be configured as a cap for closing the receptacle 2, as shown in FIG. 1, for example. In an exemplary embodiment, the cap may close the receptacle in a sealed manner.

The receptacle 2 has a threaded neck portion 7 and the cap 6 may have an assembly skirt 8 arranged to screw onto the neck portion 7. As shown in FIG. 1, the skirt 8 may have screw threading configured to engage with screw threading on the neck portion 7.

The top of the rod 5 may be connected to the cap 6 via an assembly portion 9. The assembly portion 9 may be shaped to engage via friction-fit in the assembly skirt 8 and may include a sealing lip 10 configured to press in sealed manner against the neck portion 7.

The receptacle 2 may be filled with a product P to be applied. Optionally, the product P may be a liquid, such as, for example, nail varnish. As an alternative, the product P may be a semi-liquid. Further, the receptacle 2 may be provided with a wiper member W, which may be configured so as to wipe an outer surface of the applicator element 4, for example, as the applicator element is withdrawn from the receptacle 2.

Figure 2:
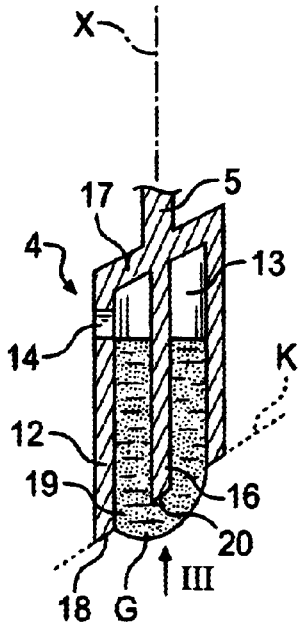
FIG. 2 is a detailed view of the applicator element of FIG. 1.

The applicator element 4 is shown on a larger scale in FIG. 2. According to the embodiment of FIG. 2, the applicator element 4 may comprise a wall 12 having a longitudinal axis X. The wall 12 may define a reservoir-forming cavity 13 in which the product P may accumulate. The wall 12 may be substantially tubular in shape. The wall 12 may be pierced radially near the top (i.e., proximal end) by a vent opening 14. In an alternative embodiment, the wall 12 may have a plurality of vent openings.

Figure 3:
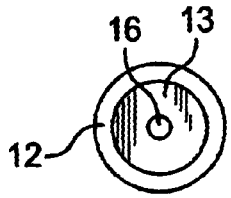
FIG. 3 is a cross-sectional view taken from the perspective of arrow III in FIG. 2.

The applicator element 4 also may comprise a retention element 16 disposed within the cavity. In other embodiments, there may be a plurality of retention elements within the cavity. As shown in the exemplary embodiment of FIG. 2, the retention element may extend along the axis X of the cavity. In this case, the retention element 16 is of substantially circular cross-section, as can be seen in FIG. 3.

The wall 12 may be connected to the rod 5 by a transverse wall 17. The retention element 16 may be connected at its top end to the transverse wall 17.

Aside from the wall 12 and transverse wall 17 shown in FIG. 2, the applicator element may comprise virtually any type of hollow enclosure that forms a cavity configured to accumulate the product to be applied. The cavity may have at least one opening through which the product passes for applying the product.

The bottom edge 18 of the wall 12 may be substantially tangential to a plane K that extends obliquely relative to the axis X of the receptacle 2. The bottom edge 18 also may define at least one opening 19.

In the optional embodiment shown, the retention element 16 has a chamfered bottom end 20 that is substantially flush with the plane K, as can be seen in FIG. 2.

The retention element 16 may serve to retain the product P via capillary attraction in the suitably narrow annular gap formed between the retention element 16 and the inside surface of the wall 12. A drop G of the product P may be formed at the opening 19. This may enable the product P to be applied on the surface at least substantially without bringing the applicator element 4 into contact with the surface.

Figure 4:
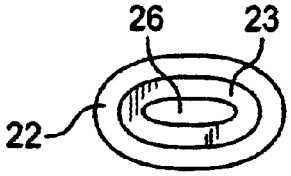
FIG. 4 is a transverse cross-sectional view of an embodiment of an applicator element.

The applicator element may have various other configurations without going beyond the scope of the present invention. By way of example, FIG. 4 shows an applicator element comprising a tubular wall 22 of substantially oblong cross-section. The retention element 26 in the center thereof co-operates with the tubular wall 22 so as to leave an annular gap 23 of substantially constant width selected as a function of the nature of the liquid to be applied, so that the liquid is retained by surface tension (i.e., capillary attraction) between the tubular wall 22 and the retention element 26.

Figure 5:
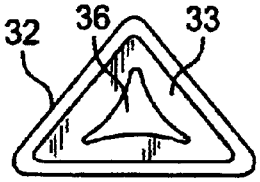
FIG. 5 is a transverse cross-sectional view of another embodiment of an applicator element.

FIG. 5 shows an applicator element comprising a wall 32 having a polygonal cross-section. More specifically, as in the optional embodiment shown in FIG. 5, the polygonal cross-section may be a triangular cross-section. The retention element 36 may have a cross-section that is substantially geometrically similar to the cross-section of the wall 32, as shown, for example, in the exemplary embodiment of FIG. 5. Alternatively, the respective cross-sections of the retention element and the wall may differ. In a manner similar to that described with reference to FIG. 2, liquid may be retained via capillary attraction between the wall 32 and the retention element 36 in a gap 33 of sufficiently small width.

Figure 6:
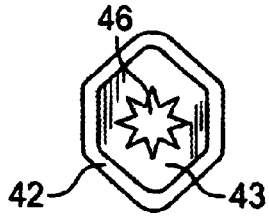
FIG. 6 is a transverse cross-sectional view of yet another embodiment of an applicator element.

FIG. 6 shows an applicator element in cross-section wherein the applicator element comprises a wall 42 of hexagonal cross-section together with a retention element 46 placed inside the cavity 43 formed by the wall 42 in order to retain the liquid between the retention element and the wall via capillary attraction.

Figure 12:
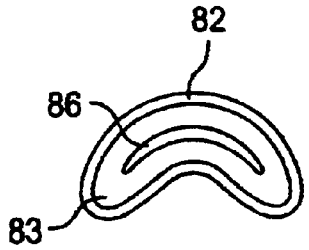
FIG. 12 is a transverse cross-sectional view of an embodiment of an applicator element.

In the exemplary embodiment of FIG. 12, the wall 82 has a substantially bean-shaped transverse cross-section and the retention element 86 has a substantially curved cross-section co-operating with the wall 82 to leave a gap 83 of substantially constant width.

Figure 7:
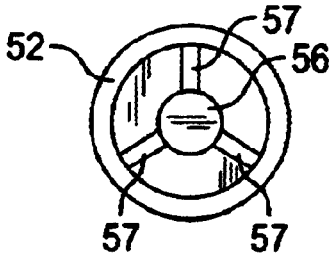
FIG. 7 is a transverse cross-sectional view of another embodiment of an applicator element.
Figure 8:
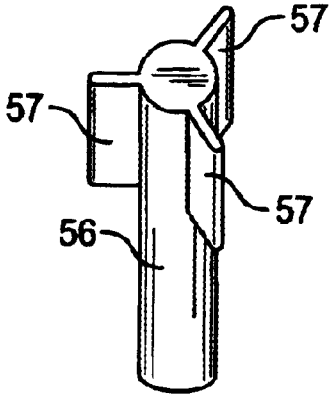
FIG. 8 is a perspective view of an embodiment of a retention element.

In the exemplary embodiment of FIG. 7, the wall 52 is of substantially circular transverse cross-section, similar to the wall 12 described above. The retention element 56 is in the form of a separate piece fitted in the cavity defined by the wall 12. This separate piece 56 is shown in FIG. 8. Near its top (i.e., proximal end), the retention element 56 comprises end fins 57 for holding it within the cavity. The fins 7 bear against the inside surface of wall 52 in a friction-fit manner so as to hold the retention element. The fins 57 may be formed integrally with the retention element 56.

In the exemplary embodiments discussed above, the applicator element presents at least one opening at its bottom end that may be suitable for forming at least a single drop of liquid.

The retention element 56 may be fixed in adjustable manner inside the wall 52, i.e. it can be pressed into the wall 52 to a greater or lesser extent, thereby having a free end that is set back at a distance to a greater or lesser extent from the opening that is used for applying the liquid. The distance between the free end of the retention element and the plane defined by the opening may be determined as a function of various factors, such as the nature of the liquid that is to be applied and the type of application, for example.

Figure 9:
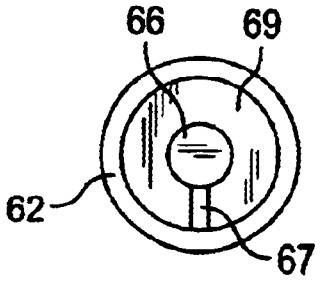
FIG. 9 is a transverse cross-sectional view of an embodiment of an applicator element.

In FIG. 9, the applicator element has a wall 62 of substantially circular cross-section and a retention element 66 connected to the wall 62 by a bridge of material 67. The bridge 67 extends radially and may be formed integrally with the wall 62 and the retention element 66 by injection-molding, for example.

The bridge of material 67 may extend as far as the bottom end of the applicator element, in which case the opening 69 used for applying the liquid may be in the form of an annulus interrupted by the bridge of material 67.

The applicator system 1 shown in FIG. 1 may optionally be used as follows. To perform application, the user may unscrew the cap 6 and extract the applicator element 4 from the receptacle 2. The cavity 13, and more specifically the volume (i.e., annular gap) defined between the retention element 16 and the tubular wall 12, may be filled with product because of the presence of the vent opening 14.

A drop G of product P may form at the opening at the bottom end of the applicator element 4, with the product P being retained by capillary attraction inside the cavity defined by the tubular wall 12. This capillary attraction may be enhanced by the presence of the retention element 16.

Figure 10:
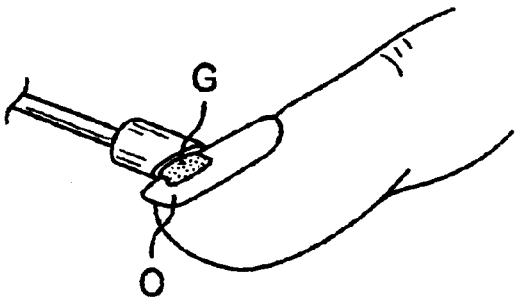
FIG. 10 is a partial perspective view showing an embodiment of an applicator used during application of nail varnish to a fingernail.

When the user brings the applicator element 4 near a surface, such as a fingernail O, for example, as shown in FIG. 10, the drop G of product P can be brought into contact with the fingernail without the applicator element 4 touching the fingernail O. This may permit the product P to be deposited and applied to the fingernail substantially without leaving stripe marks or ridges. This also may provide an advantage compared with conventional applicator elements that come into contact with the nail, such as brush applicator elements, for example.

The applicator element may comprise flocking, for example, on at least a portion of the retention element, on at least a portion of a wall defining the cavity, and/or on at least a portion of an enclosure defining the cavity.

Figure 11:
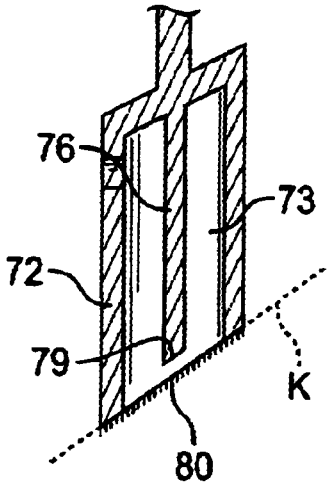
FIG. 11 is a partial axial cross-sectional view of an embodiment of an applicator element.

By way of example, FIG. 11 shows an applicator element comprising a wall 72 and a retention element 76 disposed inside a cavity defined by the wall 72. The retention element 76 and the wall 72 define a gap 73 in which the product P can be retained by capillary attraction. The bottom edge of the wall 72 may be covered in a coating of flocking 80, as shown in FIG. 11. It will be observed that the bottom end 79 of the retention element 76 can be set back slightly from the plane K defined by the opening that is used for applying the liquid.

Figure 13:
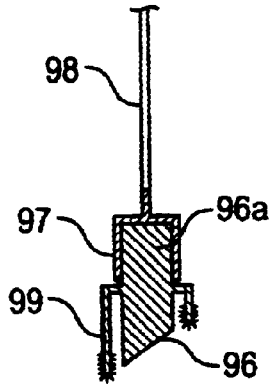
FIG. 13 is a partial axial sectional view of an embodiment of an applicator.

In the exemplary embodiment of FIG. 13, the retention element 96 and the wall 99 can be received in a housing 97 formed at the end of a rod.

In this embodiment, the retention element 96 has a top portion 96*a* that may be inserted into the housing 97 formed at the bottom end of a rod 98 which may be connected to a closure cap, such as the above-described cap 6, for example. The wall 99 surrounding the retention element 96 may be covered near its bottom in a coating of flocking, as shown.

Figure 14:
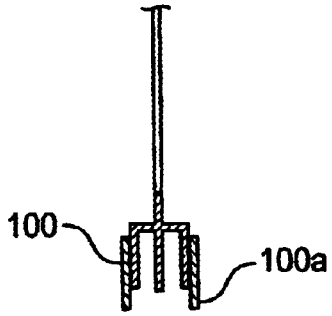
FIG. 14 is a partial axial sectional view of an embodiment of an applicator.

In an alternative exemplary embodiment, the wall that defines the cavity may be inserted inside a ring 100, as shown in FIG. 14. The bottom end 100*a* of the ring 100 may then form a downward projection extending past the distal end of the wall. The ring 100 may be made of a material that differs from the material of the retention element and the wall, for example, a material that has a different flexibility. For example, the ring 100 may be more flexible than the retention element and the wall.

Figure 15:
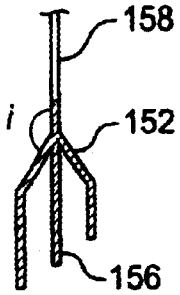
FIG. 15 is a partial axial sectional view of another embodiment of an applicator.
Figure 16:
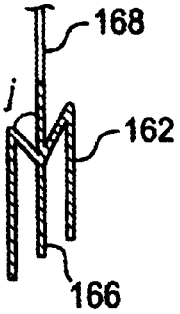
FIG. 16 is a partial axial sectional view of yet another embodiment of an applicator.

The wall also may be connected in numerous ways to the rod, as shown in FIGS. 15 to 19. Thus, the wall 152 defining the cavity containing the product can be connected to the rod 158 by forming an obtuse angle i relative thereto, as shown in FIG. 15. Alternatively, the wall 162 also may be connected to the rod 168 by forming an acute angle j, as shown in FIG. 16.

Depending on the way in which the wall connects to the rod, the end of the cavity containing the liquid can present different shapes. For example, the opening through which product passes during application may have different shapes. These different shapes may have an influence on the way in which the product is retained within the cavity and may effect the application of the product to a surface.

Figure 17:
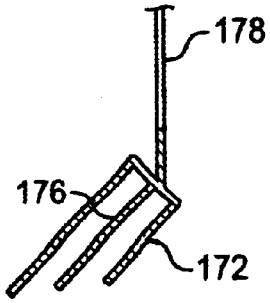
FIG. 17 is a partial axial sectional view of yet another embodiment of an applicator.

The wall 172 and the retention element 176 also may extend in a direction that is at an angle with the longitudinal axis of the rod, as shown in FIG. 17. This angle may be selected as a function of the surface region that is to be treated and/or as a function of the type of application for which the applicator is being used.

Figure 18:
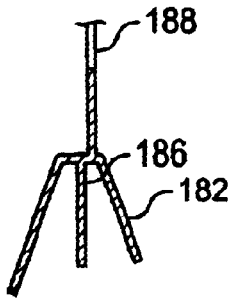
FIG. 18 is a partial axial sectional view of another embodiment of an applicator.

The wall 182 defining the reservoir-forming cavity may have an inside section that flares in a direction toward the opening, as shown in FIG. 18. That is, the wall may taper from the distal end to the proximal end of the applicator element. It also is contemplated that the wall tapers over only a portion of its length. Furthermore, an inside cross-section of the cavity may either taper or flare toward the opening. Such a taper may facilitate a more precise application of product.

Figure 19:
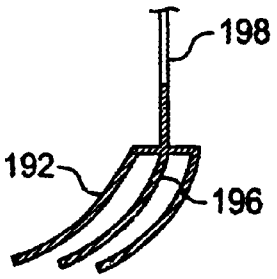
FIG. 19 is a partial axial sectional view of another embodiment of an applicator.

The wall 192, the retention element 196, or both optionally may extend along a curved longitudinal axis, as shown in FIG. 19. In this figure, it should be observed that the retention element 196 and the cavity-defining wall 192 are at an orientation in the immediate vicinity of the rod 198 that is substantially parallel to the axis of the rod 198.

Figure 20:
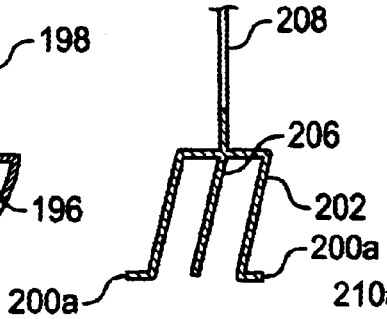
FIG. 20 is a partial axial sectional view of yet another embodiment of an applicator.
Figure 21:
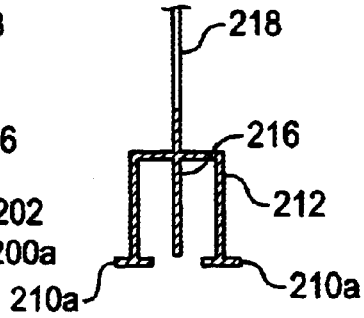
FIG. 21 is a partial axial sectional view of another embodiment of an applicator.
Figure 22:
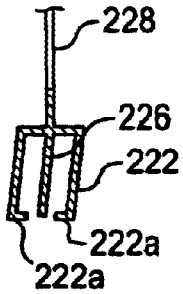
FIG. 22 is a partial axial sectional view of yet another embodiment of an applicator.

As shown in FIG. 20, the wall 202 also may have a radially outwardly-directed rim portion 200*a* around the opening. This rim portion 200*a* may be used to assist in applying the product. A rim portion 210*a* also may be provided that extends both inward and outward, as shown in FIG. 21, or the rim portion may extend inwardly only, as shown by rim portion 222*a* in FIG. 22, for example.

In general, the shape of the wall or enclosure defining the cavity for containing the product and the shape of the retention element should be selected as a function of the rheology of the product, the type of application, the materials used, and/or as a function of the space between the retention element and the wall or between the retention element and the enclosure, for example.

The shape and number of vents enabling the cavity to be filled when the applicator element is immersed in the product may be selected as a function of the nature of the product.

All or part of the applicator element may be of a flexibility that differs from that of the rod. This may permit a flexible contact with the surface to be treated, which may result in a less harsh application of product to the surface.

The cavity-forming wall, the cavity-forming enclosure, and/or the retention element may be made of a plastics material such as PE, PP, PA, PET, PC, PVC, or EVA, or optionally may be made out of an elastomer material, such as a thermoplastic elastomer material, for example.

When they are not both formed integrally by molding, the retention element can be assembled within the cavity-defining wall or cavity-defining enclosure by means of heat-sealing, crimping, securing, snap-fastening, adhesive, or other suitable means, for example.

In the exemplary embodiments described herein, the applicators were mainly described in the context of using the applicator for applying a nail varnish to a nail. However, it should be noted that the applicators, and the related systems and methods, may be used to apply a variety of cosmetic products, such as liquid eye make-up and lip make-up, and care products, such as various pharmaceutical compositions and dermo-pharmaceutical compositions. Indeed, in its broadest aspects, the present invention could be used for the application of many other types of products to many other types of surfaces, which those skilled in the art will appreciate. Furthermore, sizes of various structural parts and materials used to make these parts are illustrative and exemplary only and one of ordinary skill in the art would recognize that these materials and sizes can be changed as necessary to produce different effects or desired characteristics of the applicator or application.

It will be apparent to those skilled in the art that various modifications and variations can be made to the structure and methodology of the present invention without departing from the scope or spirit of the invention. Thus, it should be understood that the invention is not limited to the examples discussed in the specification. Rather, the present invention is intended to cover modifications and variations of this invention, provided they fall within the scope of the following claims and their equivalents.

What is claimed is:

1. An applicator for applying a product, the applicator comprising:

an applicator element configured to apply product to at least one of skin, a fingernail, a toe nail, and hair of an individual, the applicator element comprising:

a wall defining a cavity in which product accumulates, the cavity having at least one opening through which product to be applied passes, the opening being at a free end of the applicator element, and at least one retention element disposed inside the cavity, wherein the wall and the at least one retention element are configured such that the product is held between the wall and the at least one retention element via capillary attraction.

2. The applicator of claim 1, wherein the at least one opening is at a distal end of the applicator element, and wherein the wall defines at least one vent opening proximate a proximal end of the applicator element, the proximal end being located opposite to the distal end.

3. The applicator of claim 1, wherein the at least one retention element is disposed completely within the cavity.

4. The applicator of claim 3, wherein an end of the at least one retention element is substantially flush with a plane defined by the opening of the cavity.

5. The applicator of claim 3, wherein an end of the at least one retention element proximate the opening is disposed at a distance from a plane defined by the opening.

6. The applicator of claim 5, wherein the end of the at least one retention element is at a distance ranging from approximately 0.5 mm to approximately 3 mm from the plane defined by the opening.

7. The applicator of claim 5, wherein the end of the at least one retention element is at a distance ranging from approximately 1 mm to approximately 2 mm from the plane defined by the opening.

8. The applicator of claim 1, wherein the opening is disposed in a plane that extends substantially obliquely relative to a longitudinal axis of the cavity.

9. The applicator of claim 1, wherein the wall is cylindrical at least over a portion of its height.

10. The applicator of claim 1, wherein a transverse cross-section of at least a portion of the wall is substantially circular.

11. The applicator of claim 1, wherein a transverse cross-section of at least a portion of the wall is substantially oblong.

12. The applicator of claim 1, wherein a transverse cross-section of at least a portion of the wall is substantially polygonal.

13. The applicator of claim 1, wherein the at least one retention element and the wall are formed as a single piece.

14. The applicator of claim 1, wherein the at least one retention element is fixed within the cavity.

15. The applicator of claim 1, further comprising at least one fin extending from the at least one retention element and configured to hold the at least one retention element within the cavity.

16. The applicator of claim 15, wherein the at least one retention element and the at least one fin are formed as a single piece.

17. The applicator of claim 15, wherein the at least one fin extends substantially radially from the at least one retention element.

18. The applicator of claim 15, wherein the at least one fin is configured to hold the at least one retention element inside the cavity via friction fit with an interior surface of the wall.

19. The applicator of claim 1, further comprising flocking on at least a portion of at least one of the wall and the at least one retention element.

20. The applicator of claim 1, further comprising a rod, the wall being connected to the rod.

21. The applicator of claim 20, further comprising a handle member, wherein the rod is connected to the handle member.

22. The applicator of claim 21, wherein the handle member is formed as a single piece with the rod.

23. The applicator of claim 20, wherein the rod and the wall are formed as a single piece.

24. The applicator of claim 20, wherein the at least one retention element and the rod are formed as a single piece.

25. The applicator of claim 20, wherein the wall comprises a substantially vertical wall portion and a substantially transverse wall portion, the substantially transverse wall portion being connected to the rod.

26. The applicator of claim 25, wherein the substantially transverse wall portion and the rod are formed as a single piece.

27. The applicator of claim 20, further comprising a cap configured to close a receptacle for containing a product to be applied, wherein the rod is connected to the cap.

28. The applicator of claim 27, wherein the cap is configured to close the receptacle in a sealed manner.

29. The applicator of claim 20, wherein the rod is at least as flexible as the applicator element.

30. The applicator of claim 20, wherein a diameter of the rod is not larger than a diameter of the applicator element.

31. The applicator of claim 20, wherein the at least one retention element forms a non-zero angle with the rod.

32. The applicator of claim 1, wherein the at least one retention element is adjustably fixed to the wall.

33. The applicator of claim 1, wherein the at least one retention element and the wall are made of materials that differ from each other.

34. The applicator of claim 1, wherein the wall is tapered along at least part of its length.

35. The applicator of claim 1, wherein the wall flares outwardly in a direction toward the at least one opening.

36. The applicator of claim 1, wherein the at least one retention element is disposed substantially centrally within the cavity.

37. The applicator of claim 1, wherein the at least one retention element is substantially elongate.

38. The applicator of claim 1, wherein the cavity has a longitudinal axis and the at least one retention element extends substantially parallel to the longitudinal axis.

39. The applicator of claim 38, wherein the longitudinal axis of the cavity is a curved longitudinal axis.

40. A system for applying a product, the system comprising:

a receptacle configured to contain a product to be applied; and the applicator of claim 1.

41. The system of claim 40, wherein the applicator element is configured to be inserted into the receptacle.

42. The applicator of claim 41, further comprising a wiper member for wiping the applicator element as the applicator element is withdrawn from the receptacle.

43. The system of claim 42, wherein the wiper member is configured to wipe an outer surface of the wall as the applicator element is withdrawn from the receptacle.

44. The system of claim 40, further comprising the product in the receptacle, wherein the product is chosen from a care product and a cosmetic product.

45. The system of claim 44, wherein the cosmetic product is chosen from lip make-up and nail varnish.

46. The applicator of claim 1, wherein the wall and the at least one retention element are further configured such that a drop of product is formed at the opening when product is held between the wall and the at least one retention element.

47. A method of applying a product to a surface, the method comprising:

providing the applicator of claim 1;

loading the applicator element with product such that product is held between the wall and the at least one retention element;

depositing at least some of the loaded product onto a surface; and moving the applicator element relative to the surface so as to apply the product over at least a portion of the surface.

48. The method of claim 47, wherein the loading of the applicator element comprises immersing the applicator element at least partially in the product to be applied.

49. The method of claim 47, wherein the depositing of at least some of the product on the surface comprises depositing at least a drop of the product formed at the at least one opening of the cavity.

50. The method of claim 47, wherein the depositing of at least some of the product on the surface occurs at least substantially without bringing the applicator element into contact with the surface.

51. The method of claim 47, wherein the product is chosen from a cosmetic product and a care product.

52. The method of claim 51, wherein the cosmetic product is chosen from a lip make-up and a nail varnish.

53. The method of claim 47, wherein the product is chosen from one of a liquid and semi-liquid product.

54. The method of claim 47, wherein the depositing of at least some of the loaded product onto a surface comprises depositing at least some of the loaded product onto one of skin, hair, a fingernail, and a toenail.

55. The applicator of claim 1, further comprising a rod connected to the applicator element.

56. The applicator of claim 55, wherein a longitudinal axis of the applicator element forms a non-zero angle with a longitudinal axis of the rod.

57. The applicator of claim 55, wherein a longitudinal axis of the applicator is substantially parallel to a longitudinal axis of the rod.

58. The applicator of claim 1, wherein the retention element and the wall form an angle that converges toward the at least one opening.

59. An applicator for applying a product, the applicator comprising:

an applicator element configured to be loaded with product to be applied to at least one of skin, a fingernail, a toe nail, and hair of an individual, the applicator element comprising:

a wall defining a cavity in which product accumulates, the cavity having at least one opening through which product to be applied passes, the opening being at a free end of the applicator element, and at least one retention element disposed inside the cavity, wherein the wall and the at least one retention element are configured so as to hold product substantially within the cavity.

60. The applicator of claim 59, wherein the wall and the at least one retention element are configured so as to hold the product substantially within the cavity via capillary attraction.

61. The applicator of claim 59, wherein the at least one retention element is disposed substantially centrally within the cavity.

62. The applicator of claim 59, wherein the at least one retention element is substantially elongate.

63. The applicator of claim 59, wherein the cavity has a longitudinal axis and the at least one retention element extends substantially parallel to the longitudinal axis.

64. The applicator of claim 63, wherein the longitudinal axis of the cavity is a curved longitudinal axis.

65. The applicator of claim 59, wherein the at least one opening is at a distal end of the applicator element, and wherein the wall defines at least one vent opening proximate a proximal end of the applicator element, the proximal end being located opposite to the distal end.

66. The applicator of claim 59, wherein the at least one retention element is disposed completely within the cavity.

67. The applicator of claim 66, wherein an end of the at least one retention element is substantially flush with a plane defined by the at least one opening of the cavity.

68. The applicator of claim 66, wherein an end of the at least one retention element proximate the opening is disposed at a distance from a plane defined by the at least one opening.

69. The applicator of claim 68, wherein the end of the at least one retention element is at a distance ranging from approximately 0.5 mm to approximately 3 mm from the plane defined by the at least one opening.

70. The applicator of claim 68, wherein the end of the at least one retention element is at a distance ranging from approximately 1 mm to approximately 2 mm from the plane defined by the at least one opening.

71. The applicator of claim 59, wherein the at least one opening is disposed in a plane that extends substantially obliquely relative to a longitudinal axis of the cavity.

72. The applicator of claim 59, wherein the wall is cylindrical at least over a portion of its height.

73. The applicator of claim 59, wherein a transverse cross-section of at least a portion of the wall is substantially circular.

74. The applicator of claim 59, wherein a transverse cross-section of at least a portion of the wall is substantially oblong.

75. The applicator of claim 59, wherein a transverse cross-section of at least a portion of the wall is substantially polygonal.

76. The applicator of claim 59, wherein the at least one retention element and the wall are formed as a single piece.

77. The applicator of claim 59, wherein the at least one retention element is fixed within the cavity.

78. The applicator of claim 59, further comprising at least one fin extending from the at least one retention element and configured to hold the at least one retention element within the cavity.

79. The applicator of claim 78, wherein the at least one retention element and the at least one fin are formed as a single piece.

80. The applicator of claim 78, wherein the at least one fin extends substantially radially from the at least one retention element.

81. The applicator of claim 78, wherein the at least one fin is configured to hold the at least one retention element inside the cavity via friction fit with an interior surface of the wall.

82. The applicator of claim 59, further comprising flocking on at least a portion of at least one of the wall and the at least one retention element.

83. The applicator of claim 59, further comprising a rod, the wall being connected to the rod.

84. The applicator of claim 83, further comprising a handle member, wherein the rod is connected to the handle member.

85. The applicator of claim 84, wherein the handle member is formed as a single piece with the rod.

86. The applicator of claim 83, wherein the rod and the wall are formed as a single piece.

87. The applicator of claim 83, wherein the at least one retention element and the rod are formed as a single piece.

88. The applicator of claim 83, wherein the wall comprises a substantially vertical wall portion and a substantially transverse wall portion, the substantially transverse wall portion being connected to the rod.

89. The applicator of claim 88, wherein the substantially transverse wall portion and the rod are formed as a single piece.

90. The applicator of claim 83, further comprising a cap configured to close a receptacle for containing a product to be applied, wherein the rod is connected to the cap.

91. The applicator of claim 90, wherein the cap is configured to close the receptacle in a sealed manner.

92. The applicator of claim 83, wherein the rod is at least as flexible as the applicator element.

93. The applicator of claim 83, wherein a diameter of the rod is not larger than a diameter of the applicator element.

94. The applicator of claim 83, wherein the at least one retention element forms a non-zero angle with the rod.

95. The applicator of claim 59, wherein the at least one retention element is adjustably fixed to the wall.

96. The applicator of claim 59, wherein the at least one retention element and the wall are made of materials that differ from each other.

97. The applicator of claim 59, wherein the wall is tapered.

98. The applicator of claim 59, wherein the wall flares outwardly in a direction toward the at least one opening.

99. The applicator of claim 59, wherein the wall and the at least one retention element are further configured such that a drop of product is formed at the at least one opening when product is held substantially within the cavity.

100. The applicator of claim 59, further comprising a rod connected to the applicator element.

101. The applicator of claim 59, wherein a longitudinal axis of the applicator element forms a non-zero angle with a longitudinal axis of the rod.

102. The applicator of claim 101, wherein a longitudinal axis of the applicator is substantially parallel to a longitudinal axis of the rod.

103. The applicator of claim 59, wherein the retention element and the wall form an angle that converges toward the at least one opening.

104. A system for applying a product, the system comprising:

a receptacle configured to contain a product to be applied; and the applicator of claim 59.

105. The system of claim 104, wherein the applicator element is configured to be inserted into the receptacle.

106. The system of claim 104, further comprising a wiper member for wiping the applicator element as the applicator element is withdrawn from the receptacle.

107. The system of claim 106, wherein the wiper member is configured to wipe an outer surface of the wall as the applicator element is withdrawn from the receptacle.

108. The system of claim 104, further comprising the product in the receptacle, wherein the product is chosen from a care product and a cosmetic product.

109. The system of claim 104, wherein the cosmetic product is chosen from lip make-up and nail varnish.

110. A method of applying a product to a surface, the method comprising:

providing the applicator of claim 59;

loading the applicator element with product such that product is held substantially within the cavity;

depositing at least some of the loaded product onto a surface; and moving the applicator element relative to the surface so as to apply the product over at least a portion of the surface.

111. The method of claim 110, wherein the loading of the applicator element comprises immersing the applicator element at least partially in the product to be applied.

112. The method of claim 110, wherein the depositing of at least some of the product on the surface comprises depositing at least a drop of the product formed at the at least one opening of the cavity.

113. The method of claim 110, wherein the depositing of at least some of the product on the surface occurs at least substantially without bringing the applicator element into contact with the surface.

114. The method of claim 110, wherein the product is chosen from a cosmetic product and a care product.

115. The method of claim 114, wherein the cosmetic product is chosen from a lip make-up and a nail varnish.

116. The method of claim 110, wherein the product is chosen from one of a liquid and semi-liquid product.

117. The method of claim 110, wherein the depositing of at least some of the loaded product onto a surface comprises depositing at least some of the loaded product onto one of skin, hair, a fingernail, and a toenail.

118. An applicator for applying a product, the applicator comprising:

an applicator element configured to be loaded with product to be applied to at least one of skin, a fingernail, a toe nail, and hair of an individual, the applicator element comprising:

a substantially elongate, hollow enclosure having a proximal end and a free distal end, the distal end defining at least one opening through which product to be applied passes, and at least one retention element disposed within the hollow enclosure, wherein the enclosure and the at least one retention element are configured so as to hold product substantially within the enclosure.

119. The applicator of claim 118, wherein the enclosure and the retention element are configured so as to hold the product substantially within the enclosure via capillary attraction.

120. The applicator of claim 118, wherein the at least one retention element is disposed substantially centrally within the enclosure.

121. The applicator of claim 118, wherein the at least one retention element is substantially elongate.

122. The applicator of claim 118, wherein the enclosure has a longitudinal axis and the at least one retention element extends substantially parallel to the longitudinal axis.

123. The applicator of claim 122, wherein the longitudinal axis of the enclosure is a curved longitudinal axis.

124. The applicator of claim 118, wherein the wall defines at least one vent opening proximate the proximal end of the enclosure.

125. The applicator of claim 118, wherein the at least one retention element is disposed completely within the enclosure.

126. The applicator of claim 125, wherein an end of the at least one retention element is substantially flush with a plane defined by the at least one opening.

127. The applicator of claim 125, wherein an end of the at least one retention element proximate the at least one opening is disposed at a distance from a plane defined by the at least one opening.

128. The applicator of claim 127, wherein the end of the at least one retention element is at a distance ranging from approximately 0.5 mm to approximately 3 mm from the plane defined by the at least one opening.

129. The applicator of claim 127, wherein the end of the at least one retention element is at a distance ranging from approximately 1 mm to approximately 2 mm from the plane defined by the at least one opening.

130. The applicator of claim 118, wherein the at least one opening is disposed in a plane that extends substantially obliquely relative to a longitudinal axis of the enclosure.

131. The applicator of claim 118, wherein the enclosure is substantially cylindrical in shape over at least a portion of its height.

132. The applicator of claim 118, wherein a transverse cross-section of at least a portion of the enclosure is substantially circular.

133. The applicator of claim 118, wherein a transverse cross-section of at least a portion of the enclosure is substantially oblong.

134. The applicator of claim 118, wherein a transverse cross-section of at least a portion of the enclosure is substantially polygonal.

135. The applicator of claim 118, wherein the at least one retention element and the enclosure are formed as a single piece.

136. The applicator of claim 118, wherein the at least one retention element is fixed within the enclosure.

137. The applicator of claim 118, further comprising at least one fin extending from the at least one retention element and configured to hold the at least one retention element within the enclosure.

138. The applicator of claim 137, wherein the at least one retention element and the at least one fin are formed as a single piece.

139. The applicator of claim 137, wherein the at least one fin extends substantially radially from the at least one retention element.

140. The applicator of claim 137, wherein the at least one fin is configured to hold the at least one retention element inside the enclosure via friction fit with an inner surface of the enclosure.

141. The applicator of claim 118, further comprising flocking on at least a portion of at least one of the enclosure and the at least one retention element.

142. The applicator of claim 118, further comprising a rod, the enclosure being connected to the rod.

143. The applicator of claim 142, further comprising a handle member, wherein the rod is connected to the handle member.

144. The applicator of claim 143, wherein the handle member is formed as a single piece with the rod.

145. The applicator of claim 142, wherein the rod and the enclosure are formed as a single piece.

146. The applicator of claim 142, wherein the at least one retention element and the rod are formed as a single piece.

147. The applicator of claim 142, wherein the enclosure comprises a vertical wall portion and a transverse wall portion, the transverse wall portion being connected to the rod.

148. The applicator of claim 147, wherein the transverse wall portion and the rod are formed as a single piece.

149. The applicator of claim 142, further comprising a cap configured to close a receptacle for containing a product to be applied, wherein the rod is connected to the cap.

150. The applicator of claim 149, wherein the cap is configured to close the receptacle in a sealed manner.

151. The applicator of claim 142, wherein the rod is at least as flexible the applicator element.

152. The applicator of claim 142, wherein a diameter of the rod is not larger than a diameter of the applicator element.

153. The applicator of claim 142, wherein the at least one retention element forms a non-zero angle with the rod.

154. The applicator of claim 118, wherein the at least one retention element is adjustably fixed to the enclosure.

155. The applicator of claim 118, wherein the at least one retention element and the enclosure are made of materials that differ from each other.

156. The applicator of claim 118, wherein at least a portion of the enclosure is tapered.

157. The applicator of claim 118, wherein the enclosure flares outwardly in a direction toward the at least one opening.

158. The applicator of claim 118, wherein the enclosure and the at least one retention element are further configured such that a drop of product is formed at the at least one opening when product is held substantially within the enclosure.

159. The applicator of claim 118, further comprising a rod connected to the applicator element.

160. The applicator of claim 159, wherein a longitudinal axis of the applicator element forms a non-zero angle with a longitudinal axis of the rod.

161. The applicator of claim 159, wherein a longitudinal axis of the applicator is substantially parallel to a longitudinal axis of the rod.

162. The applicator of claim 118, wherein the retention element and the enclosure form an angle that converges toward the at least one opening.

163. A system for applying a product, the system comprising:

a receptacle configured to contain a product to be applied; and the applicator of claim 118.

164. The system of claim 163, wherein the applicator element is configured to be inserted into the receptacle.

165. The system of claim 163, further comprising a wiper member for wiping the applicator element as the applicator element is withdrawn from the receptacle.

166. The system of claim 165, wherein the wiper member is configured to wipe an outer surface of the enclosure as the applicator element is withdrawn from the receptacle.

167. The system of claim 163, further comprising the product in the receptacle, wherein the product is chosen from a care product and a cosmetic product.

168. The system of claim 167, wherein the cosmetic product is chosen from lip make-up and nail varnish.

169. A method of applying a product to a surface, the method comprising:

providing the applicator of claim 118;

loading the applicator element with product such that product is held substantially within the enclosure;

depositing at least some of the loaded product onto a surface; and moving the applicator element relative to the surface so as to apply the product over at least a portion of the surface.

170. The method of claim 169, wherein the loading of the applicator element comprises immersing the applicator element at least partially in the product to be applied.

171. The method of claim 169, wherein the depositing of at least some of the product on the surface comprises depositing at least a drop of the product formed at the at least one opening.

172. The method of claim 169, wherein the depositing of at least some of the product on the surface occurs at least substantially without bringing the applicator element into contact with the surface.

173. The method of claim 169, wherein the product is chosen from a cosmetic product and a care product.

174. The method of claim 173, wherein the cosmetic product is chosen from lipstick and nail varnish.

175. The method of claim 169, wherein the product is chosen from one of a liquid and semi-liquid product.

176. The method of claim 169, wherein the depositing of at least some of the loaded product onto a surface comprises depositing at least some of the loaded product onto one of skin, hair, a fingernail, and a toenail.

177. An applicator for applying a product, the applicator comprising:

an applicator element configured to apply product, the applicator element comprising:

a wall defining a cavity in which product accumulates, the cavity having at least one opening through which product to be applied passes, and at least one retention element comprising a portion disposed inside the cavity, wherein the wall and the at least one retention element are configured such that the product is held between the wall and the at least one retention element via capillary attraction and such that a drop of product is formed at the opening when product is held between the wall and the at least one retention element.

178. An applicator for applying a product, the applicator comprising:

an applicator element configured to be loaded with product to be applied, the applicator element comprising:

a wall defining a cavity in which product accumulates, the cavity having at least one opening through which product to be applied passes, and at least one retention element comprising a portion disposed inside the cavity, wherein the wall and the at least one retention element are configured so as to hold product substantially within the cavity and such that a drop of product is formed at the at least one opening when product is held substantially within the cavity.

179. An applicator for applying a product, the applicator comprising:

an applicator element configured to apply product to at least one of skin, a fingernail, a toe nail, and hair of an individual, the applicator element comprising:

a wall defining a cavity in which product accumulates, the cavity having at least one opening through which product to be applied passes, and at least one retention element comprising a portion disposed inside the cavity, wherein the wall and the at least one retention element are configured such that the product is held between the wall and the at least one retention element via capillary attraction, and wherein the applicator lacks bristles.

180. An applicator for applying a product, the applicator comprising:

an applicator element configured to be loaded with product to be applied to at least one of skin, a fingernail, a toe nail, and hair of an individual, the applicator element comprising:

a wall defining a cavity in which product accumulates, the cavity having at least one opening through which product to be applied passes, and at least one retention element comprising a portion disposed inside the cavity, wherein the wall and the at least one retention element are configured so as to hold product substantially within the cavity, and wherein the applicator lacks bristles.

* * * * *

UNITED STATES PATENT AND TRADEMARK OFFICE

CERTIFICATE OF CORRECTION

PATENT NO. : 6,666,607 B2
DATED : December 23, 2003
INVENTOR(S) : Jean-Louis H. Gueret It is certified that error appears in the above-identified patent and that said Letters Patent is hereby corrected as shown below:

Column 10,
Line 10, replace “comprising:” with -- comprising --;

Column 12,
Line 58, replace “comprising:” with -- comprising --;

Column 15,
Line 45, replace “comprising:” with -- comprising --;

Column 17,
Line 23, replace “flexible the” with -- flexible as the --;

Column 18,
Lines 47 and 62, replace “comprising:” with -- comprising --;

Column 19,
Line 10, replace “comprising:” with -- comprising --; and

Column 20,
Line 8, replace “comprising:” with -- comprising --.

Signed and Sealed this

Sixteenth Day of March, 2004

JON W. DUDAS
*Acting Director of the United States Patent and Trademark Office*